US007090215B2

(12) United States Patent
Mandel et al.

(10) Patent No.: US 7,090,215 B2
(45) Date of Patent: Aug. 15, 2006

(54) PRINTER PAPER PATH PLURAL NIPS RELEASING SYSTEM

(75) Inventors: Barry P. Mandel, Fairport, NY (US); Lloyd A. Williams, Mahopac, NY (US); Joannes N. M. deJong, Hopewell Junction, NY (US); Keith A. Buddendeck, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 581 days.

(21) Appl. No.: 10/462,429

(22) Filed: Jun. 16, 2003

(65) Prior Publication Data

US 2004/0251607 A1 Dec. 16, 2004

(51) Int. Cl.
*B65H 5/06* (2006.01)

(52) U.S. Cl. ..... 271/273; 271/274

(58) Field of Classification Search ..... 271/272–274, 271/117–118, 18.2
See application file for complete search history.

(56) References Cited

U.S. PATENT DOCUMENTS 3,722,655 A * 3/1973 Singer ..... 400/613.1
5,030,025 A * 7/1991 Mitcham et al. ..... 400/636
5,324,015 A * 6/1994 Freitag ..... 271/9.01
5,846,007 A * 12/1998 Nakayama et al. ..... 400/624
5,984,305 A * 11/1999 Inoue ..... 271/291
6,056,284 A * 5/2000 Shin ..... 271/114
6,070,867 A * 6/2000 Tsurumi et al. ..... 271/114
6,173,952 B1 * 1/2001 Richards et al. ..... 271/228
6,817,611 B1 * 11/2004 DiRamio ..... 271/273
6,991,392 B1 * 1/2006 Hult et al. ..... 400/624
2002/0074718 A1 * 6/2002 Schlageter ..... 271/227

* cited by examiner

*Primary Examiner*—Eileen D. Lillis
*Assistant Examiner*—Jeremy R. Severson

(57) ABSTRACT

A system for automatically releasing selected plural sheet feeding nip sets spaced along a print media sheet feeding path of a printer, wherein the idler rollers are rotatably mounted on common idler shafts and a selectable partial rotation system driven by a single low cost motor is flexibly connected to those plural idler shafts to partially rotate eccentric lift cams on each idler shaft into the underlying surface as to lift the idler shaft and thereby move the idler rollers away from their normally mating sheet feed rollers to release all the sheet feeding nips, enabling sheet deskew, inversion, acceleration, deceleration, or sheet jam clearance in that selected area of the sheet feeding path.

1 Claim, 3 Drawing Sheets

PRINTER PAPER PATH PLURAL NIPS RELEASING SYSTEM

Disclosed in the embodiments herein is an improved low cost and simple, system for automatically or selectively opening all or selected sheet feeding nips of the print media paper path of a printer. In particular, to allow the easier removal of sheets from the paper path by the machine operator in the event of sheet jams. In the disclosed embodiments plural sheet feeding nip sets may be commonly opened with a single low cost motor. Single or plural nip sets may be automatically opened in response to existing sheet jam location sensors and software output control signals and/or operator GUI or other switch inputs. In the disclosed embodiments one or more sheet feeding nip sets (sheet feeding locations) may be opened by simply partially rotating existing idler roller shafts to rotate two or more (or one centrally located) low cost eccentric cams directly mounted on those shafts into engagement with an adjacent existing sheet baffle.

Various types of (mostly manual) sheet feeding nip opening systems for xerographic and other printers have been known in the published art, or internally suggested. The schematically over-simplified FIGS. 3 and 4 herein are noted by way of two examples of the latter. Note that both of those examples require a separate solenoid or motor for each sheet feeding nips set, and note that a solenoid will reclose the nips if its electrical power is not maintained.

Particularly noted in the published art as to selectable plural automatic nip openings is Xerox Corp. U.S. Pat. No. 6,173,952 B1 issued Jan. 16, 2001 to Paul N. Richards, et al. Note especially FIG. 8 thereof, inter alia. However, may be readily seen by one skilled in the art, the indirect camming nip opening system disclosed in that U.S. Pat. No. 6,173,952 is much more complex and costly, and is for a much more critical application of temporarily evenly releasing a trailing portion of a large (long) sheet which is being deskewed in the nip of a sheet deskewing and lateral registration system, and requires separate servo or stepper motors for each set of sheet feeding nips.

A specific feature of the specific embodiments disclosed herein is to provide a system for releasing at least one of plural sheet feeding nip sets in a print media sheet feeding path of a printer, wherein said plural sheet feeding nip sets are spaced along said print media sheet feeding path of said printer, and wherein said sheet feeding nip sets comprise plural sheet feed rollers and plural mating idler rollers; and wherein said printer print media sheet feeding path is defined by sheet baffles, wherein said plural idler rollers of said sheet feeding nip sets are rotatably mounted on a common idler shaft, a selectable partial rotation system is connected to said common idler shaft to provide partial rotation of said common idler shaft, at least one eccentric lift cam is mounted on said common idler shaft to rotate with said partial rotation of said common idler shaft, and wherein said common idler shaft is mounted adjacent to, but movable towards and away from, a said sheet baffle by engagement of said eccentric lift cam with said sheet baffle by said partial rotation of said common idler shaft by said selectable partial rotation system so as to move said plural idler rollers away from said plural sheet feed rollers to release at least one of said plural sheet feeding nip sets.

Further specific features disclosed in the embodiments herein, individually or in combination, include those wherein said selectable partial rotation system is connected to rotate plural common idler shafts of plural sheet feeding nip sets to release said plural sheet feeding nip sets; and/or wherein said selectable partial rotation system consists of a single low speed drive motor and a common drive interconnection between said single low speed drive motor and plural spaced apart said common idler shafts of plural said spaced apart sheet feeding nip sets; and/or wherein said selectable partial rotation system comprises a single motor connected to commonly rotate plural common idler shafts of plural sheet feeding nip sets to commonly release said plural sheet feeding nip sets, further including a common moveable rack system moved by said single motor and pinion gears on said plural common idler shafts of said plural nip sets which pinion gears are rotatably engaged by said common moveable rack system; and/or wherein said selectable partial rotation system comprises a motor and at least one flexible shaft rotated by said single motor and connected to at least one said common idler shaft of at least one sheet feeding nip set to rotate said common idler shaft and thereby release said sheet feeding nip set; and/or wherein said selectable partial rotation system is actuated in response to a sheet jam control signal; and/or wherein said selectable partial rotation system is actuated in response to a sheet registration, inversion, acceleration, or deceleration control signal; and/or in which multiple nip sets are released, and in which the position of the eccentric lift cam of one nip set is rotatably offset from those of other nip sets as to provide a different nip release of different nip sets when said selectable partial rotation system is actuated; and/or a method of releasing a sheet for enhanced removal from a sheet feeding nip set in a sheet feeding path by opening said sheet feeding nip set, wherein plural said sheet feeding nip sets are spaced along said printer sheet feeding path, and wherein said sheet feeding nip sets comprise plural sheet feed rollers normally engaged by plural idler rollers; and wherein said printer sheet feeding path is defined by sheet baffles, wherein said plural idler rollers of said sheet feeding nip set are rotatably mounted on a common idler shaft, and at least one eccentric lift cam is mounted on said same common idler shaft to rotate with partial rotation of said common idler shaft, selectably partially rotating at least one of said common idler shafts to rotate said eccentric lift cam thereon against a said sheet baffle to move said common idler shaft away from said sheet baffle to thereby move said plural idler rollers of said sheet feeding nip set away from said plural sheet feed rollers of said sheet feeding nip set to thereby open at least one of said plural sheet feeding nip sets; and/or wherein said selectable partial rotation commonly rotates plural common idler shafts of plural sheet feeding nip sets to commonly open plural sheet feeding nip sets with a single drive motor; and/or wherein said selectable partial rotation commonly rotates plural common idler shafts of plural sheet feeding nip sets to commonly open plural sheet feeding nip sets with a single drive motor via a rack interconnection rotating pinion gears on the ends of plural common idler shafts; and/or wherein said selectably partially rotating of said common idler shaft system to rotate said eccentric lift cams against at least one of said sheet baffles is provided by a single motor and a flexible shaft connection.

The disclosed system may be operated and controlled by appropriate operation of conventional control systems. It is well-known and preferable to program and execute imaging, printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate for images, whether precut or web fed. A "copy sheet" may be abbreviated as a "copy" or called a "hardcopy."

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the examples below, and the claims. Thus, the present invention will be better understood from this description of these specific embodiments, including the drawing figures (which are approximately to scale) wherein:

Figure 3:
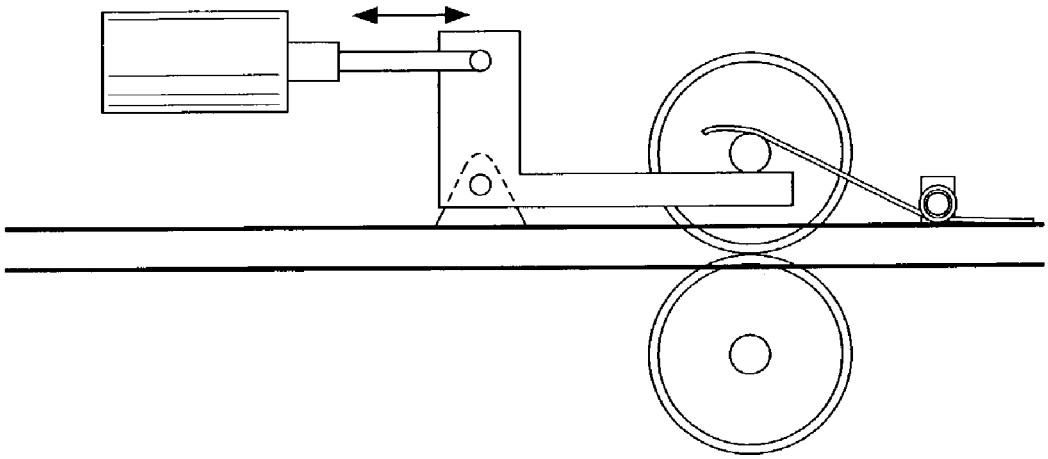
Figure 4:
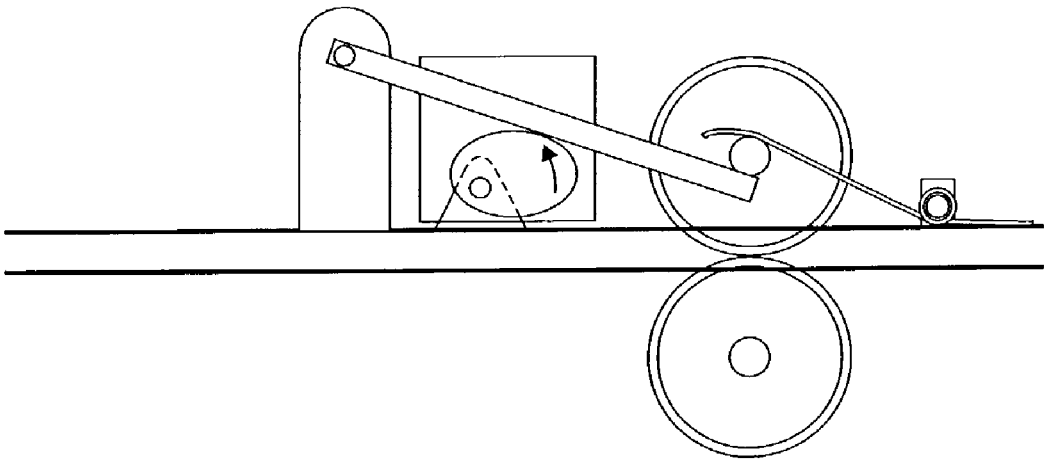

FIG. 3 is a partially schematic side view of a different and only single nip set opening system with a separate solenoid and lever arrangement for each nip set that is not exemplary of the present invention; and FIG. 4 is a partially schematic side view of a further different and only single nip set opening system with a separate motor and cam and lever arrangement for each nip set that is not exemplary of the present invention.

Figure 1:
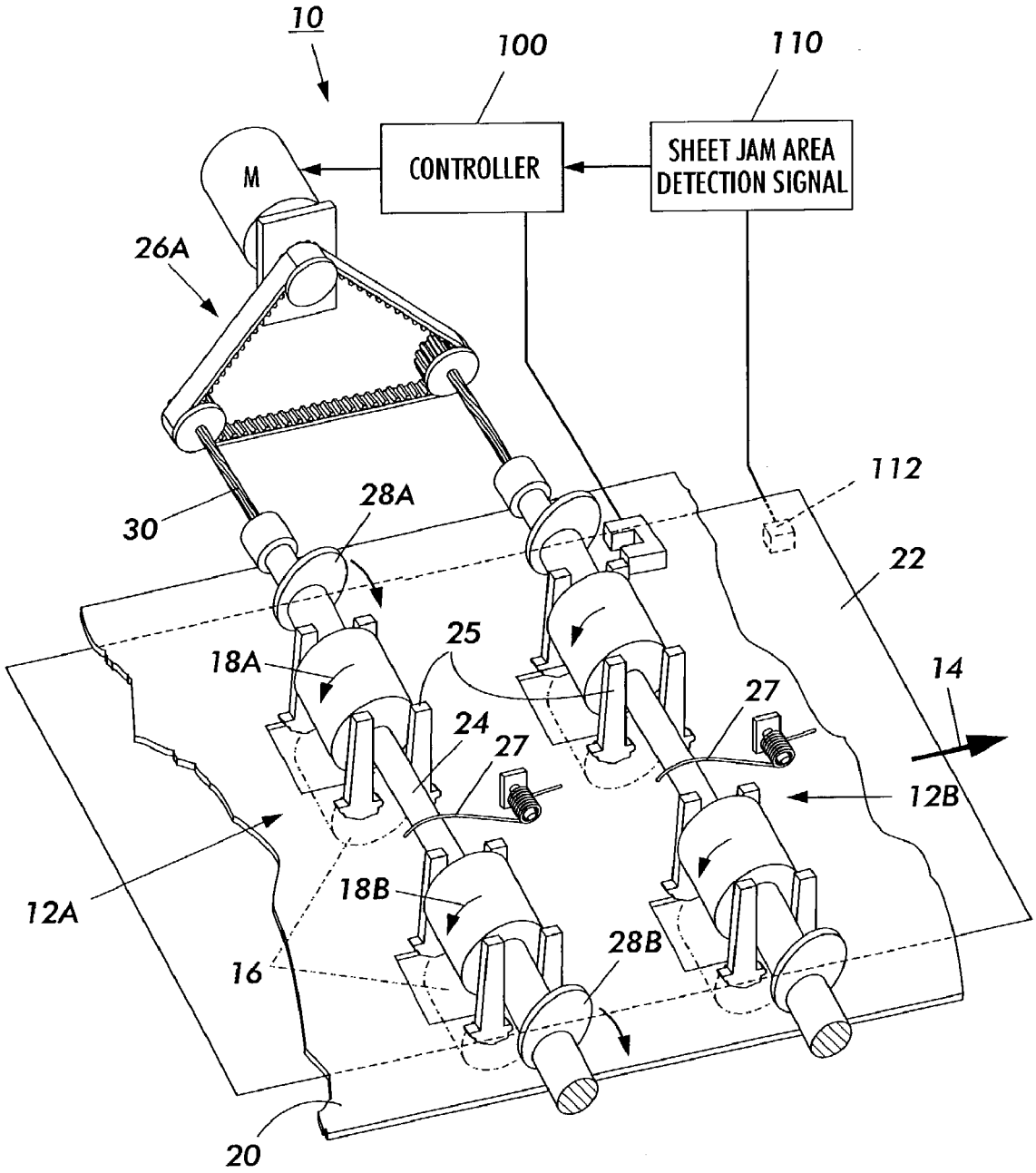
FIG. 1 is a perspective partially schematic partial view of an exemplary printer paper path with one example of the subject automatic plural nips sets opening system for removal of a detected jammed sheet.
Figure 2:
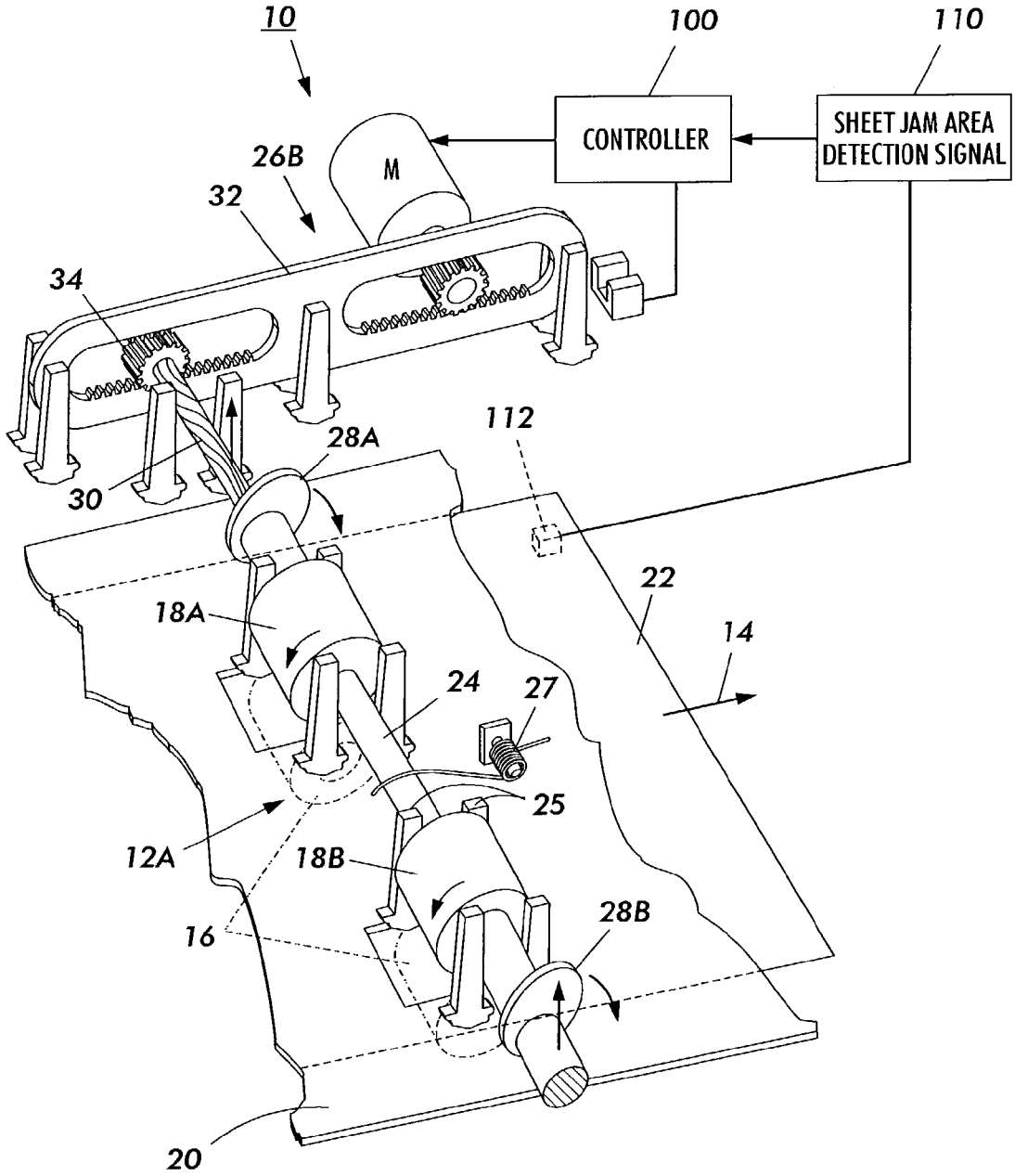
FIG. 2 is similar to FIG. 1 but illustrating a slightly different embodiment.

Describing now in further detail the exemplary embodiments of FIGS. 1 and 2, there is shown an automatic nip opening system 10, by way of one example of the subject system.

The illustrated system 10 can automatically opening plural nip sets (here 12A and 12*b*) along a printer sheet path 14. Each of the nip sets 12A, 12B, etc., may conventionally extend transversely across the sheet path 14 and comprise at least two spaced apart conventionally driven sheet feed rollers 16.

For sheet feeding these feed rollers 16 are engaged by mating nip forming idlers 18 (18A and 18B) with a normal force provided by gravity and/or a spring such as 27, to provide a positive sheet feeding nip for feeding a sequence of sheets such as 22 downstream in the printer sheet path 14.

These nip forming idlers 18*a* and 18*b* are freely rotatable upon a common idler shaft 24.

The sheet path 14 is conventionally defined by a plurality of spaced apart upper and lower baffles 20. Conventionally, the feed rolls 16 and idlers 18 extend through apertures in the baffle 20. The common idler shaft 24 for the idlers is relatively closely spaced above the upper baffle 20 or the lower baffle, depending on the orientation of the sheet feeding system and the radius of the idlers.

The common idler shafts 24 of each of the multiplicity of nip sets 12A, 12B, etc. extending along the sheet feed path 14 are conventionally mounted to allow limited vertically floating movement within their illustrated parallel vertical guides 25, each of which are spaced apart by a slightly greater distance than the diameter of the idler shaft 24. This freedom of vertical movement is normally provided only for small variations in the deformation of the urethane or other elastomeric feed rollers 16 and/or the mating idler rollers 18, and the slight movement of these idlers 18*a*, 18*b* to accommodate a thick sheet passing through the nips of the nip set. Also, in conventional such systems the idler shaft 24 does not rotate.

Turning now to the specific embodiments herein, in the system 10 eccentric cams 28A, 28B are provided near the outer ends of the idler shaft 24, fastened to rotate with the shaft 24. In the system 10 the shaft 24 is selectably partially rotated so that these two cams 28A, 28B are rotated into engagement with the baffle 20 to lift up the shaft 24 evenly from both ends. Thus, the rotated shaft 24 lifts up within the parallel supporting links 25 sufficiently to completely disengage and open the sheet feeding nips between the idlers 18 and their previously mating feed rolls 16. This nip opening allows sheet deskew, acceleration or deceleration by an alternate drive means, or unobstructed removal of a jammed sheet 22 from the sheet path 14 at convenient locations without having to forcibly pull the sheet from a closed nip with possible tearing of the sheet.

In the embodiment of FIG. 1, this partial rotation of the shaft 24 to open all of the nips of that nip set is through a flexible shaft 30 driven by a rotation system 26. Here that shaft rotation system comprises a single low cost low power motor M with a timing belt drive of plural flexible shafts 30 for commonly opening a plurality of adjacent nip sets spaced upstream or downstream from one another along the sheet feeding path 14. (Two of such nip sets, 12A and 12B, are illustrated in FIG. 1 somewhat closer together than normal for illustrative purposes).

The opening of all of the nip sets engaging a particular sheet for jam clearance of that sheet, even a long sheet, can be completely automated as shown on the examples of both FIGS. 1 and 2. That is, conventional existing optical or other sheet position or timing sensors, such as 112 schematically illustrated, may conventionally operate conventional sheet jam area detection signals software such as 110 for the machine controller 100 in a conventional manner. That information as to the location of the sheet jam can be utilized, as shown, to operate the single low cost motor M. This motor M, which provides the rotation system 26A of FIG. 1 or 26B of FIG. 2, may be operated in that area of the paper path 14 in which the jam is detected to release all of the sheet feeding nips in that area.

The embodiment of FIG. 2 differs from the embodiment of FIG. 1 in that the partial rotation of the shaft 24 to open the nips is provided by an elongate rack interconnection system 32 driven from a spur driving gear by the motor M to in turn drive spur gears 34 on the ends of the shafts 24. The cost of a plastic molded rack link drive 32 to several nip sets could be very low. This FIG. 2 system may be in lieu of, or in combination with, a flexible drive shaft 30 connection as in FIG. 1. Various simple flexible or compliant couplings are well known in the art for such a flexible coupling.

It will be appreciated that the present systems may be utilized in other paper handling systems and devices, such as sheet deskew and/or registration systems, which also involve sheet driving nips which may need to be released for other functions, such as deskewing of the sheet and its registration, as well as for jam clearances. Also, it may be utilized in sheet inverters where it is desirable to temporarily open a sheet feeding nip set widely to allow sheets to simultaneously enter and exit the inverter chute, passing by each other through the open nip.

It should also be appreciated that the proposed nip release system could be used to open multiple nips at different times. If the start position of the idler cams was different on each nip set, each nip set could be opened in a specific sequence or at a specific time. This could be useful in a registration system, in which an upstream nip set may need to close to accept the next sheet, while a downstream nip set was still released to enable sheet deskew or acceleration.

Due to the mechanical advantages of the present system, a very low power and inexpensive motor may be utilized as comparable to the cost of a solenoid, yet without the reliability, timing, and life problems of solenoids.

Also, the present system can be "low profile" and need not increase space requirements for the paper path area. That is, the motor M may be located completely outside of the paper path, unlike other alternatives of FIGS. 3 and 4, etc.

Note that to re-close the nips, the motor M can either be driven for a short distance in the same direction, or driven in the reverse direction, to rotate the eccentric cams 28A, 28B sufficiently to disengage from the baffle 20 and allow the normal force from the center spring 27 or their normal force arrangement to again re-engage the idlers against the drive rolls for positive sheet feeding nips.

Note that the normal force springs 27 illustrated here are not the same as conventional such idler shaft force springs. They are designed as shown to provide a relatively uniform normal force even though the idler shaft 24 may be lifted 2 or 3 mm or more by the cams 28A, 28B upon the rotation of the idler shaft 24 to open the nips.

Two cams 28A, 28B are shown near the opposite ends of each shaft 24.

However, a sufficiently wide enough single central cam could be an alternative. Also, as shown, a "home position" sensor ben be provided to indicate the cam(s) rotation starting and/or ending position.

It will be appreciated that various presently unforeseen or unanticipated alternatives, modifications, variations or improvements therein may be subsequently made by those skilled in the art which are also intended to be encompassed by the following claims.

What is claimed is:

1. A sheet feeding system for feeding print media sheets along a portion of a sheet path defined by baffles with plural sets of sheet driving rollers and mating idler rollers spaced along said sheet path, wherein plural said idler rollers are freely rotatably mounted on plural spaced apart idler shafts spaced along said sheet path and spaced from at least one said baffle, said plural spaced apart idler shafts are mounted to allow movement towards and away from said baffles, said plural spaced apart idler shafts have rotatable eccentric cams at opposing end areas thereof, and a commonly driven idlers disengagement system with a single drive motor rotatably connecting with all of said plural spaced apart idler shafts to selectably rotate all of said rotatable eccentric cams on all of said plural spaced apart idler shafts to rotatably engage all of said eccentric cams against said baffle to push all of said plural spaced apart idler shafts away from said baffle to disengage all of said plural idler rollers from all of said plural sheet driving rollers.

* * * * *